US008177226B2

(12) United States Patent
Kikkawa et al.

(10) Patent No.: US 8,177,226 B2
(45) Date of Patent: May 15, 2012

(54) SHEET PROCESSING APPARATUS AND IMAGE FORMING APPARATUS

(75) Inventors: Naohiro Kikkawa, Kanagawa (JP); Masahiro Tamura, Kanagawa (JP); Nobuyoshi Suzuki, Tokyo (JP); Shuuya Nagasako, Kanagawa (JP); Kazuhiro Kobayashi, Kanagawa (JP); Tomohiro Furuhashi, Kanagawa (JP); Hiroshi Maeda, Aichi (JP); Tomoichi Nomura, Aichi (JP); Makoto Hidaka, Tokyo (JP); Hitoshi Hattori, Tokyo (JP); Junichi Tokita, Kanagawa (JP); Akira Kunieda, Tokyo (JP); Ichiro Ichihashi, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 12/186,563

(22) Filed: Aug. 6, 2008

(65) Prior Publication Data

US 2009/0039593 A1 Feb. 12, 2009

(30) Foreign Application Priority Data

Aug. 6, 2007 (JP) ..... 2007-203918

(51) Int. Cl.
*B65H 31/26* (2006.01)

(52) U.S. Cl. ..... 271/220; 271/207

(58) Field of Classification Search ..... 271/207, 271/220

See application file for complete search history.

(56) References Cited

U.S. PATENT DOCUMENTS

| | | | | |
|---|---|---|---|---|
| 3,385,598 | A * | 5/1968 | Jong-Dok Kim | 271/176 |
| 5,181,705 | A * | 1/1993 | Ueda et al. | 271/3.15 |
| 7,407,155 | B2 | 8/2008 | Tamura et al. | |
| 7,410,158 | B2 | 8/2008 | Iida et al. | |
| 7,416,177 | B2 | 8/2008 | Suzuki et al. | |
| 7,530,565 | B2 * | 5/2009 | Terao et al. | 271/207 |
| 2002/0113362 | A1 * | 8/2002 | Saito et al. | 271/207 |
| 2002/0163119 | A1 * | 11/2002 | Kawata | 271/207 |
| 2006/0022394 | A1 | 2/2006 | Tamura et al. | |
| 2006/0180999 | A1 | 8/2006 | Suzuki et al. | |
| 2007/0056423 | A1 | 3/2007 | Yamada et al. | |
| 2007/0069453 | A1 * | 3/2007 | Thomas et al. | 271/207 |

FOREIGN PATENT DOCUMENTS

| | | |
|---|---|---|
| JP | 64-56448 | 4/1989 |
| JP | 10-109804 | 4/1998 |
| JP | 2001-019252 | 1/2001 |
| JP | 2001-199616 | 7/2001 |
| JP | 2003-192220 | 7/2003 |

* cited by examiner

*Primary Examiner* — Kaitlin Joerger
*Assistant Examiner* — Ernesto Suarez
(74) *Attorney, Agent, or Firm* — Oblon, Spivak, McClelland, Maier & Neustadt, L.L.P.

(57) ABSTRACT

A sheet processing apparatus and associated method are provided. The sheet processing apparatus includes a sheet conveying path, a sheet stack tray, a sheet discharging member, a sheet guide member, and a sheet contact portion. The sheet conveying path is configured to convey a sheet, the sheet discharging member discharges the sheet to the sheet stack tray, and the sheet stack tray receives the sheet. The sheet guide member is movable from a first position that guides the sheet discharged from the sheet discharging member to a second position that opens a sheet discharge path of the sheet discharging member. The sheet contact portion is arranged at an upstream side of the sheet discharging member with respect to the sheet conveying path, and responds to the sheet conveyed through the sheet conveying path in order to move the sheet guide member between the first and second positions.

7 Claims, 5 Drawing Sheets

SHEET PROCESSING APPARATUS AND IMAGE FORMING APPARATUS

CROSS-REFERENCE TO RELATED APPLICATIONS

This application is based upon and claims priority under 35 U.S.C. §119 to Japanese Patent Application No. 2007-203918, filed Aug. 6, 2007, the entire contents of which are hereby incorporated by reference.

BACKGROUND OF THE INVENTION

1. Field of the Invention

The present invention relates to a sheet processing apparatus, an associated method, and an image forming apparatus.

2. Description of the Background Art

As a technique concerning sheet processing apparatuses, for example, Japanese Patent Application Laid-Open Nos 2001-19252 and 2001-199616 disclose a technology relating to a sheet processing apparatus that applies predetermined processing to a sheet-like recording medium (sheet). As shown in FIG. 1, the sheet processing apparatus staples the sheet bundle fed from a pair of discharging rollers 505 on to a staple tray 501. The sheet processing apparatus includes a sheet guide member 507, which is freely rotatable so as to guide the sheet fed from the discharging rollers 505 to the staple tray 501.

As shown in FIG. 1A, in an initial state, the sheet guide member 507 is located in a position that obstructs a nip portion of the discharging rollers 505. When a sheet proceeds into the discharging rollers 505 in that state, the sheet guide member 507 rotates in the direction shown by the arrow R due to being pushed up by the leading edge of the sheet and opens the nip portion of the discharging rollers 505.

After discharging the sheet from the discharging rollers 505, as shown in FIG. 1B, the sheet guide member 507 rotates in a direction shown by the arrow S toward the initial state due to its own weight. Then the sheet guide member 507 guides the sheet to the staple tray 501 by pressing the trailing edge of the sheet. As shown in FIG. 1C, the sheet guide member 507 prevents the sheet from conveying backward (the direction shown by the arrow T) by obstructing the nip portion of the discharging rollers 505 in this state. Afterward, as shown in FIG. 1D, the sheet fed from the discharging rollers 505 is stacked on the staple tray 501.

However, such a sheet processing apparatus can generate a paper feed malfunction, as illustrated in FIG. 2. For example, if a soft sheet or a sheet that is curled to the staple tray 501 is discharged from the discharging rollers 505, the sheet hangs loose as shown FIG. 2B after the leading edge of the sheet has passed the nip portion of the discharging rollers 505.

As shown in FIG. 2C, the leading edge of the sheet discharges to the staple tray 501 while being pressed in the direction shown by the arrow U by the sheet guide member 507, which is rotated to its initial state by its own weight. In this state, when the leading edge of the sheet touches the staple tray 501, the edge is curled as shown FIG. 2D and it causes a conveying malfunction.

SUMMARY

The present invention has been made in view of the above-mentioned circumstances.

It is an object of the present invention to at least partially solve the problems in the conventional technology.

A sheet processing apparatus according to one exemplary aspect of the present invention includes a sheet conveying path configured to convey a sheet, a sheet stack tray that receives the sheet in order to stack the sheet, a sheet discharging member that discharges the sheet conveyed through the sheet conveying path to the sheet stack tray, a sheet guide member, and a sheet contact portion. The sheet guide member is movable from a first position that guides the sheet discharged from the sheet discharging member to a second position that opens a sheet discharging path of the sheet discharging member. The sheet contact portion is arranged at an upstream side of the sheet discharging member with respect to the sheet conveying path, and responds to the sheet conveyed through the sheet conveying path in order to move the sheet guide member between the first and second positions.

In another exemplary aspect, a sheet processing apparatus includes a sheet conveying path configured to convey a sheet, a sheet stack tray that receives the sheet in order to stack the sheet, a sheet discharging member that discharges the sheet conveyed through the sheet conveying path to the sheet stack tray, a means for guiding the sheet, and a means for responding to the sheet. The means for guiding the sheet is movable from a first position that guides the sheet discharged from the sheet discharging member to a second position that opens a sheet path of the sheet discharging member. The means for responding to the sheet is arranged at an upstream side of the sheet discharging member with respect to the sheet conveying path, and responds to the sheet conveyed through the sheet conveying path in order to move the means for guiding the sheet between the first and second positions.

In another exemplary aspect, a method for guiding a sheet within a processing apparatus includes conveying a sheet along a sheet conveying path and discharging the sheet conveyed through the sheet conveying path from a sheet discharge member into a sheet stack tray. The method also includes guiding the sheet into the sheet stack tray by moving a sheet guide member from a first position that guides the sheet discharged from the sheet discharging member to a second position that opens a sheet path of the sheet discharging member. The moving the sheet guide member is initiated by a sheet contact portion located upstream of the sheet discharge member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXEMPLARY EMBODIMENTS

Exemplary embodiments of the present invention are explained in detail below with reference to the accompanying drawings.

Figure 1A:
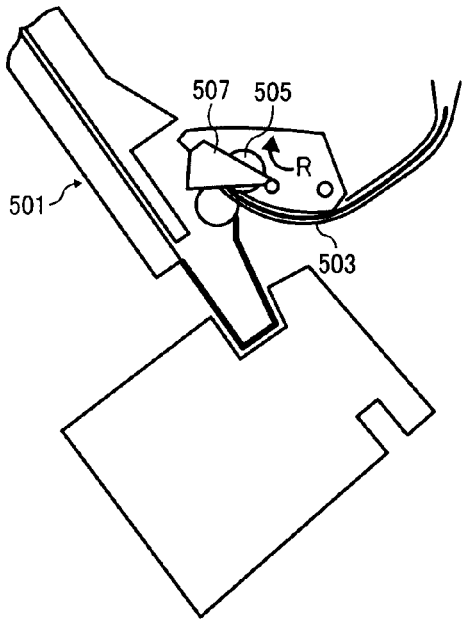
FIG. 1A BACKGROUND ART
FIGS. 1A through 1D illustrate a cross-sectional view of a known sheet processing apparatus including a sheet guide member.
Figure 1B:
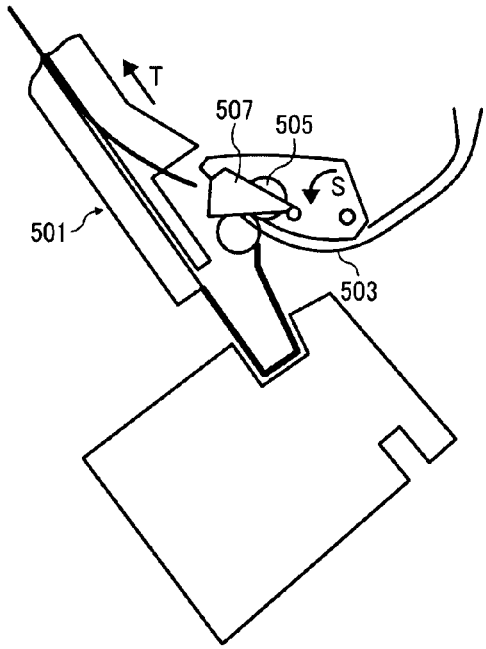
FIG. 1B BACKGROUND ART
Figure 1C:
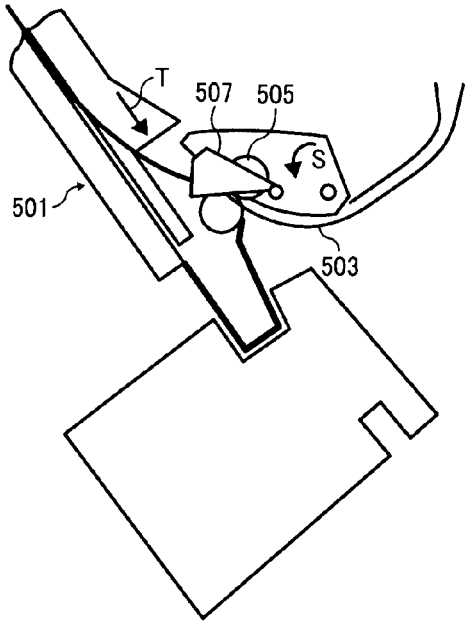
FIG. 1C BACKGROUND ART
Figure 1D:
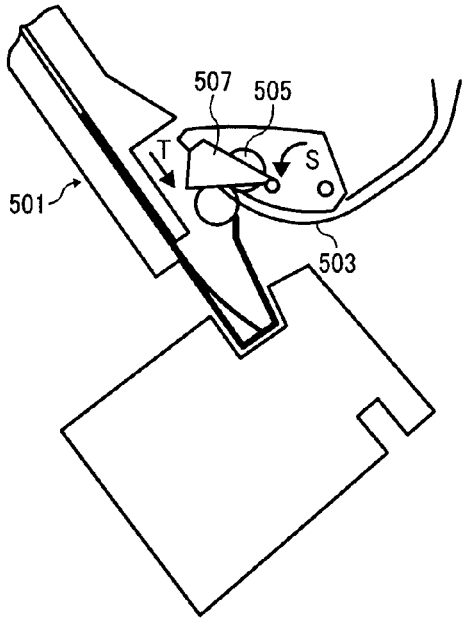
FIG. 1D BACKGROUND ART
Figure 2A:
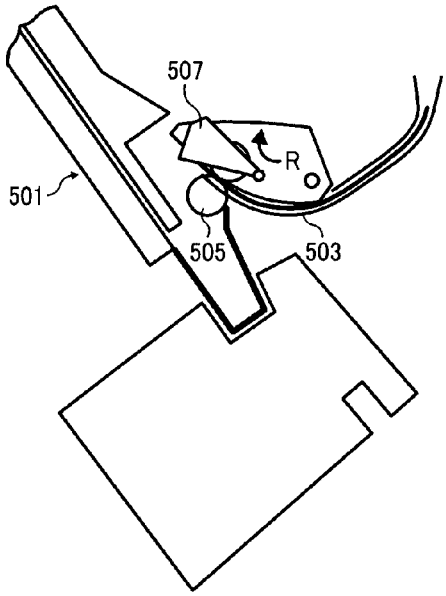
FIGS. 2A through 2D illustrate a cross-sectional view of a known sheet processing apparatus including a sheet guide member that illustrates a sheet feeding malfunction.
Figure 2B:
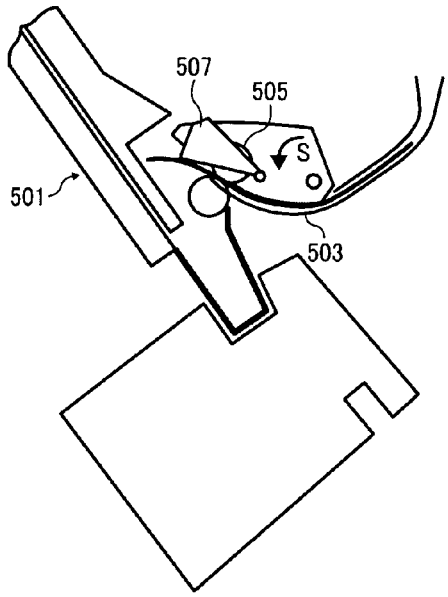
Figure 2C:
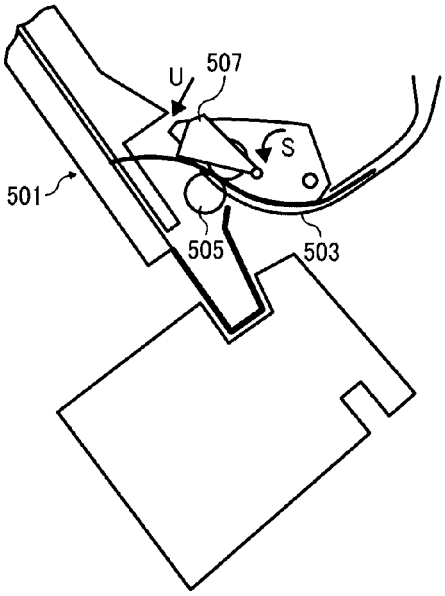
Figure 2D:
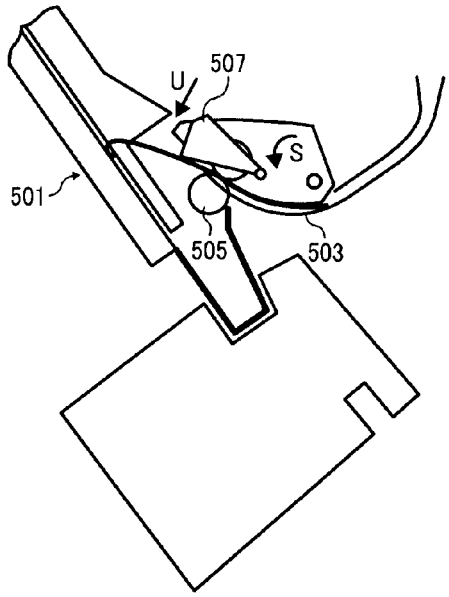
Figure 3:
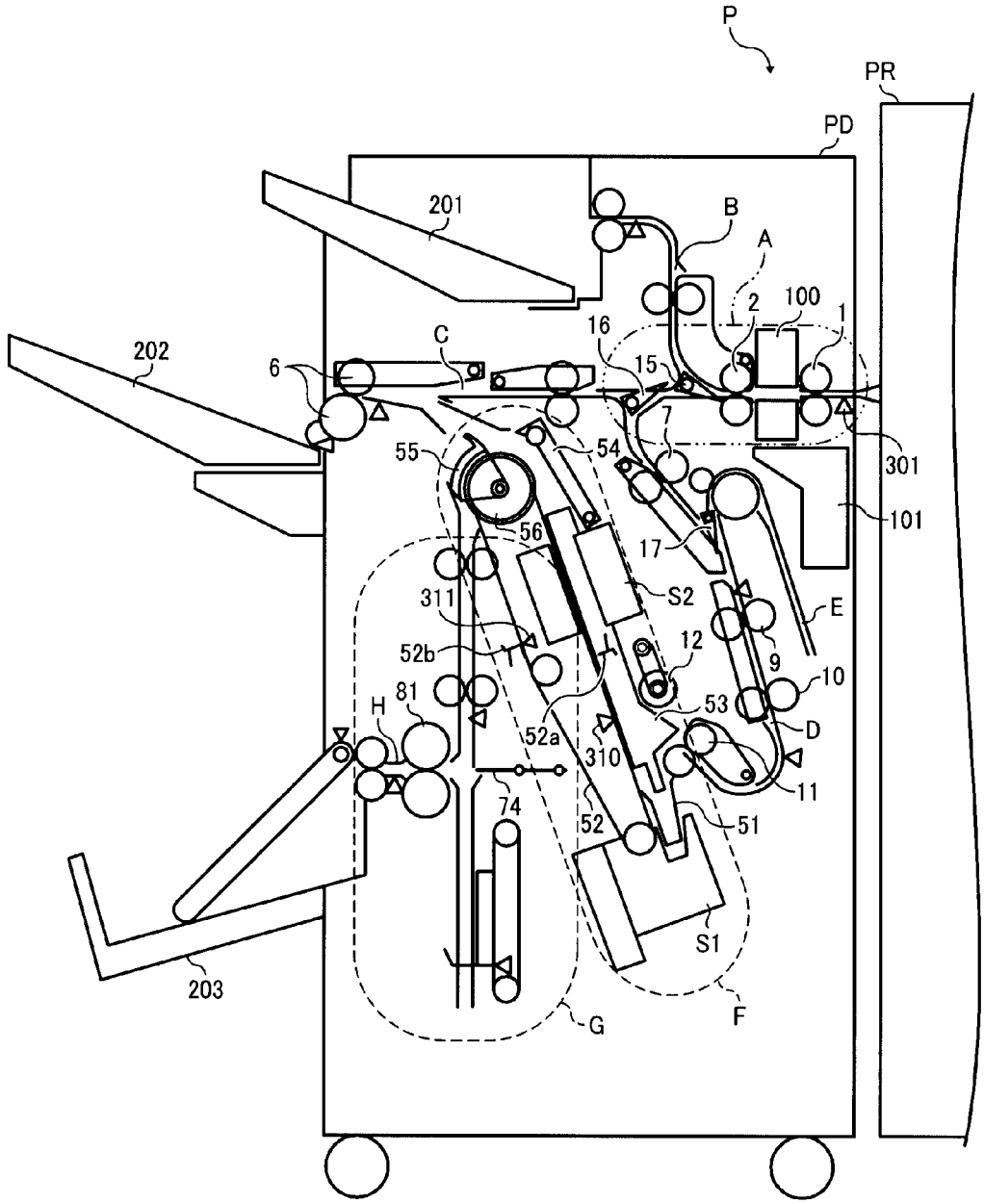
FIG. 3 illustrates a schematic cross-sectional view of an image forming apparatus and a sheet processing apparatus according to an exemplary embodiment.

FIG. 3 is a diagram of a system including a sheet processing apparatus and an image forming apparatus according to a first embodiment of the present invention.

In FIG. 3, a sheet processing apparatus PD and a part of the image forming apparatus PR are shown.

In FIG. 3, the sheet processing apparatus PD is attached to a side of the image forming apparatus PR. Sheet-like recording medias (sheets) discharged from the image forming apparatus PR are guided to the sheet processing apparatus PD. The sheets pass through a conveying path A, which includes a punch unit 100, and are then divided by a branch pawl 15 and a branch pawl 16 so as to be distributed to a conveying path B that guides the sheets to an upper tray 201, a conveying path C that guides the sheets to a shift tray 202, or a conveying path D that guides the sheets to a staple processing tray F (also referred to as conveying tray) that performs alignment, staple binding, and the like.

Sheets that are guided to the staple processing tray F, through the conveying paths A and D, are subjected to alignment, stapling, and the like in the staple processing tray F. These sheets then are divided so as to be distributed to the conveying path C, which guides the sheets to the shift tray 202, or a folding processing tray G (also referred to as center-folding processing tray) by a guide plate 54 and a movable guide 55. The sheets subjected to folding and the like in the folding processing tray G are then guided to a lower tray 203 through a conveying path H.

A branch pawl 17 is arranged in the conveying path D. After a trailing edge of a sheet conveyed by conveying rollers 7 passes the branch pawl 17, the sheet is conveyed backward by reversely rotating, from among conveying rollers 9 and 10 and staple sheet discharging rollers 11, at least the conveying rollers 9. The trailing edge of the sheet is guided to a sheet storing unit E to hold up the sheet in the sheet storing unit E. This makes it possible to stack the next sheet on the sheet and convey both the sheets. It is also possible to stack and convey two or more sheets by repeating this operation.

In the conveying path A are sequentially arranged an inlet sensor 301 that detects the sheet received from the image forming apparatus PR, inlet rollers 1 provided on a downstream side, a punch unit 100, a punch chip hopper 101, conveying rollers 2, the branch pawl 15, and the branch pawl 16. When a non-depicted solenoid is turned on, the branch pawl 15 swivels upwards, and the branch pawl 16 swivels downwards, thereby distributing the sheet to the conveying path B, the conveying path C, and the conveying path D.

When leading the sheet to the conveying path B, the branch pawl 15 turns off the solenoid. When leading the sheet to the conveying path C, the solenoid is turned on. As a result, the branch pawl 15 swivels upwards, and the branch pawl 16 swivels downwards, respectively. When leading the sheet to the conveying path D, the branch pawl 16 turns off the solenoid, and the branch pawl 15 turns on the solenoid. As a result, they are swiveled upwards.

In this sheet processing apparatus, it is possible to apply various kinds of processing such as punching (the punch unit 100), sheet alignment and end binding (a jogger fence 53 and an end-face binding stapler S1), sheet alignment and center binding (jogger fence 53 and a center-binding stapler S2), sheet dividing (the shift tray 202), and center folding (a folding plate 74 and folding rollers 81).

The image forming apparatus PR includes, although not shown in the drawings, a photosensitive member that a toner image which correspond to a manuscript image is formed, a transferring device that transfers a toner image visualized by the photosensitive member onto a sheet, and a fixing device that fixes the toner image transferred onto the sheet and delivers the sheet to the sheet processing apparatus PD, and the like.

Figure 4:
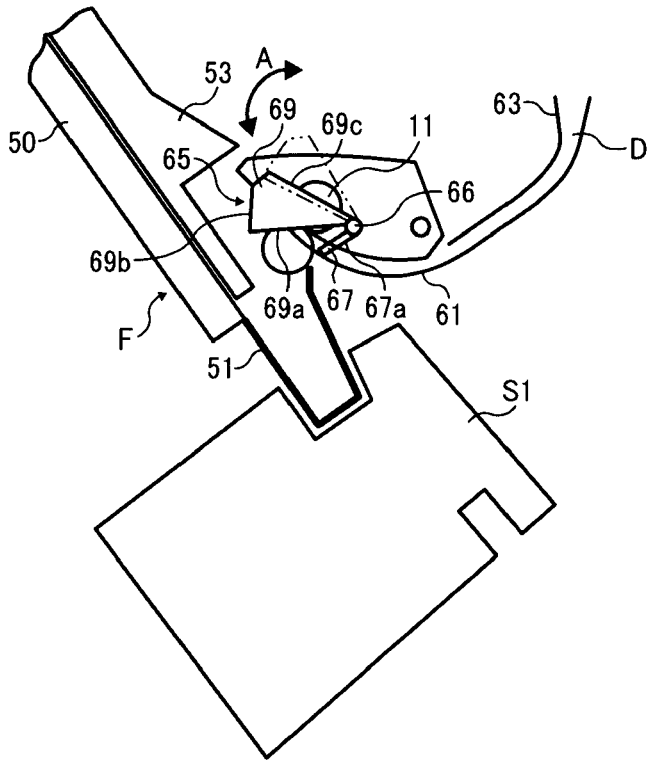
FIG. 4 illustrates an enlarged cross-sectional view showing a sheet guide member included in the sheet processing apparatus.

FIG. 4 shows specific configurations of the staple processing tray F and its surroundings. As shown in FIG. 4, the conveying path D includes a lower guide plate 61 and an upper guide plate 63 which are configured as the conveying path D. The end portions of the downstream side of the lower guide plate 61 and the upper guide plate 63 are bent in a U-shaped. On the downstream side of the lower guide plate 61 and the upper guide plate 63 are sequentially arranged the staple sheet discharging rollers 11 and the staple processing tray F. In other words, the staple sheet discharging rollers 11 are arranged between the staple processing tray F and the conveying path D.

The staple processing tray F includes a sheet receiving portion 50 which is inclined in a direction that is orthogonal with respect to the initial sheet conveying direction (the initial sheet conveying direction is to the left in FIG. 2) and receives an undersurface of a sheet and holds the sheet, a rear fence 51 which receives a trailing edge of a sheet discharged from the staple sheet discharging rollers 11, and sheet jogger fences 53 which align a sheet in a sheet width direction.

A sheet guide member 65, which is rotatable and guides a sheet fed from the staple sheet discharging rollers 11 to the staple processing tray F, is arranged near the staple sheet discharging rollers 11.

The sheet guide member 65 is arranged so as to be freely rotatable about a fulcrum 66 located at the upstream side of the staple sheet discharging rollers 11 and above the upper guide plate 63 from an initial position that obstructs the nip portion (i.e., a sheet conveying path) of the staple sheet discharging rollers 11 (shown by a solid line in FIG. 4) to an evacuating position that opens the nip portion of the staple sheet discharging rollers 11 (the evacuating position is shown by a dashed line in FIG. 4). The direction of the rotation between the first and second position is shown by an arrow A in FIG. 4.

The sheet guide member 65 includes a rotation portion 67 and a pressing portion 69. The rotation portion 67 is plate-like and is located at the upstream side of the staple sheet discharging rollers 11 with respect to the sheet conveying path in the initial position. The pressing portion 69 is located at the downstream side of the rotation portion 67 with respect to the sheet conveying path and obstructs the nip portion of the staple sheet discharging rollers 11.

In this example, the rotation portion 67 crosses the conveying path D when the sheet guide member 65 is located at the initial position by extending from the fulcrum 66 located at the upstream side of the staple sheet discharging rollers 11 and above the upper guide plate 63 toward the lower guide plate 61 (the direction is obliquely downward of left in FIG. 4). In this example, the pressing portion 69 extends from the fulcrum 66 toward the downstream side of the staple sheet discharging rollers 11 (the direction is obliquely upward of left in FIG. 4). The cross-section shape of the sheet guide member 65 is configured in a V-shape by the rotation portion 67 and the pressing portion 69.

The rotation portion 67 extends into the inside of the path formed by the guide plates 61,63 up to a point where an edge of the rotation portion reaches proximate to the inside surface of the lower guide plate 61. A lower surface of the rotation portion 67 is a contact surface 67*a* which is bumped by a sheet fed through the conveying path D configured by the guide plates 61,63. The guide member 65 rotates from the initial position to the evacuating position when the rotation portion 67 is bumped and pushed up by the leading edge of the sheet.

Figure 5:
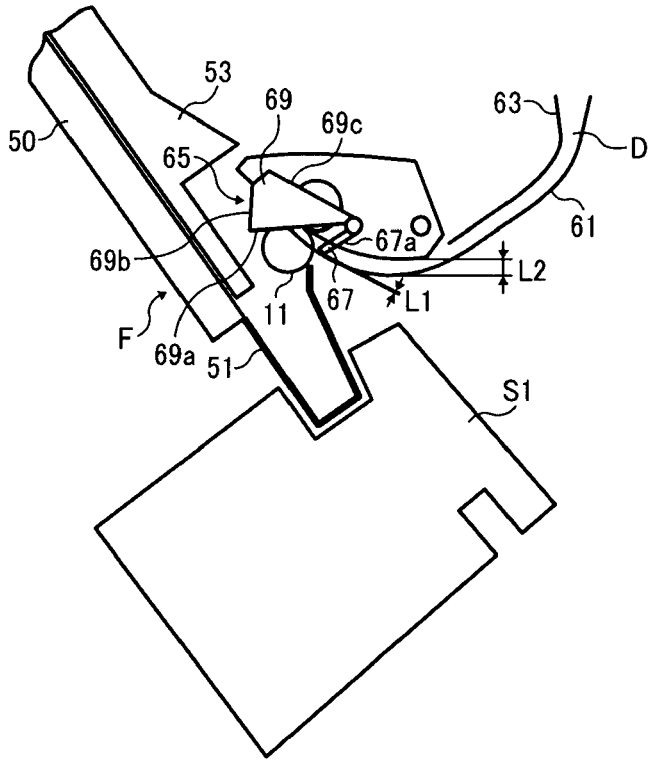
FIG. 5 illustrates an enlarged cross-sectional view showing a relation between the sheet guide member and a conveying path.

In this example, as shown in FIG. 5, a gap L1 between the leading edge of the rotation portion 67 (i.e., the leading edge of the contact surface 67*a*) and the inside surface of the lower guide plate 61 is smaller than a distance L2 between the lower guide plate 61 and the upper guide plate 63 (i.e., the inside diameter of the conveying path D). This configuration makes it possible to ensure that a leading edge of a sheet fed between both of the guide plates 61,63 touches the contact surface 67*a*.

As shown in FIG. 4, the cross-section shape of the pressing portion 69 is a substantially triangular. In particular, the pressing portion 69 is formed with a base 69*a* (also referred to as the pressing surface) which extends substantially horizontally from the fulcrum 66, a rising side 69*b* (also referred to as the guide surface) which extends vertically from the base 69*a*, and a sloping side 69*c* which obliquely extends from the rising side 69*b* to the fulcrum 66.

In this example, the base 69*a* presses a trailing edge of a sheet discharged from the staple sheet discharging rollers 11 to the sheet receiving portion 50 of the staple processing tray F. And the rising side 69*b* guides the trailing edge of the sheet bumped into the rising side 69*b* to the rear fence 51 of the staple processing tray F.

The guide member 65 is designed such that an angle between the contact surface 67*a* and the pressing surface 69*a* causes the pressing surface 69*a* to be located above the direction that the staple sheet discharging rollers 11 discharge a sheet (i.e., the normal line direction of the nip portion of the staple sheet discharging rollers 11) when the sheet guide member 65 is in the evacuating position so as to prevent the pressing surface 69*a* from the interfering the sheet being discharged from the staple sheet discharging rollers 11.

The sheets sequentially conveyed by the staple sheet discharging rollers 11 to the staple processing tray F are sequentially stacked on the staple tray F. At this instant, as shown in FIG. 3, a knock roller 12 knocks every sheet so as to align it in the vertical direction (direction of sheet conveyance) while jogger fences 53 align the sheet in the horizontal direction perpendicular to the sheet conveyance (sometimes referred to as a direction of sheet width). Between consecutive jobs, i.e., during an interval between the last sheet of a sheet stack and the first sheet of the next sheet stack, a control unit (not shown) outputs a staple signal for causing the end-face binding stapler S1 to perform a stapling operation. A discharge belt 52 with a hook 52*a* immediately conveys the stapled sheet stack to shift outlet rollers 6, so that the shift outlet rollers 6 conveys the sheet stack to the shift tray 202 held at a receiving position. In addition, the number 310 in FIG. 3 is a sheet sensor which is responsive to the presence and absence of a sheet stack on the staple processing tray F.

A belt HP (Home Position) sensor 311 senses the hook 52*a* of the discharge belt 52 brought to its home position. More specifically, two hooks 52*a* and 52*b* are positioned on the discharge belt 52 face-to-face at spaced locations in the circumferential direction and alternately convey sheet stacks stapled on the staple processing tray F one after another. The discharge belt 52 may be moved in the reverse direction such that one hook 52*b* held in a stand-by position and the back of the other hook 52*a* aligns the leading edge of the sheet stack stored in the staple processing tray F in the direction of sheet conveyance, as needed. The hook 52*a* therefore plays the role of aligning means at the same time.

The operation of the sheet guide member 65 will be described hereinafter with reference to FIG. 6.

Figure 6A:
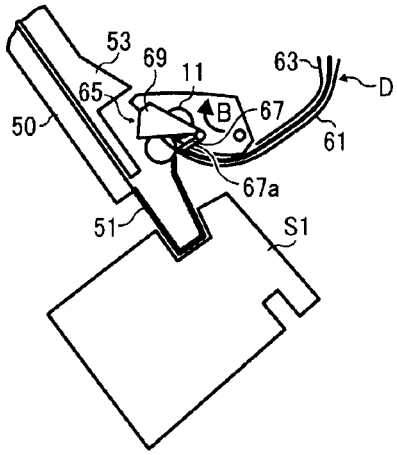
FIGS. 6A through 6F illustrate a cross-sectional view showing a behavior of the sheet guide member.
Figure 6B:
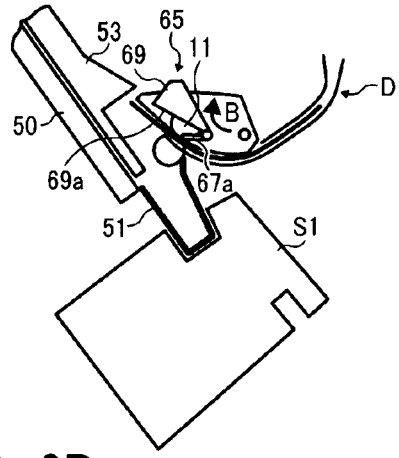

As shown in FIG. 6A, when a sheet that is fed in the guide member 61,63, which is configured as the conveying path D, reaches near the staple sheet discharging rollers 11, the sheet bumps into and pushes up the contact surface 67*a* of the rotation portion 67 of the sheet guide member 65. Because of this, the sheet guide member 65 rotates from the initial position to the evacuating position (as shown by an arrow B in FIG. 6A).

When the sheet guide member 65 is in the evacuating position, the sheet guide member 65 is maintained at the evacuation position because the edge of the contact surface 67*a* is in contact with the sheet discharged from the staple sheet discharging rollers 11 at the inlet of the nip of the staple sheet discharging rollers 11.

Figure 6C:
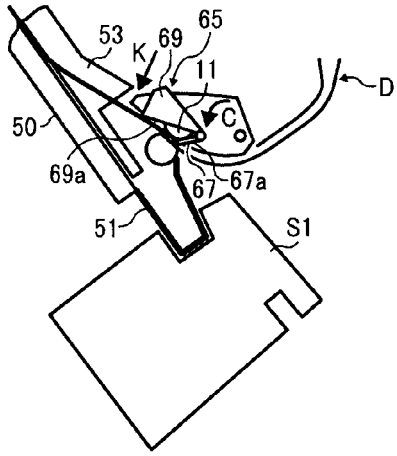

In this state, the sheet is discharged from the staple sheet discharging rollers 11. As shown in FIG. 6C, when the sheet separates from the contact surface 67*a*, the sheet guide member 65 rotates (returns) toward the initial position as shown by an arrow C due to its own weight. Because of this, the pressing surface 69*a* of the pressing portion 69 presses the trailing edge portion of the sheet toward the sheet receiving portion 50 of the staple processing tray F (the direction is shown by an arrow K).

Figure 6D:
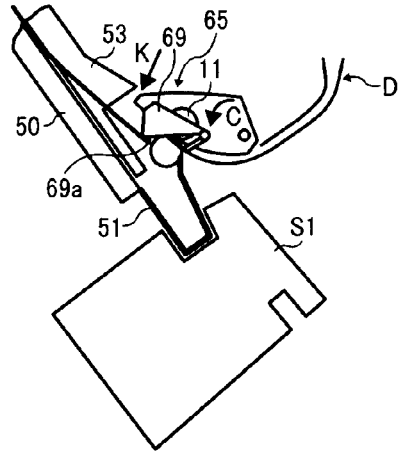
Figure 6E:
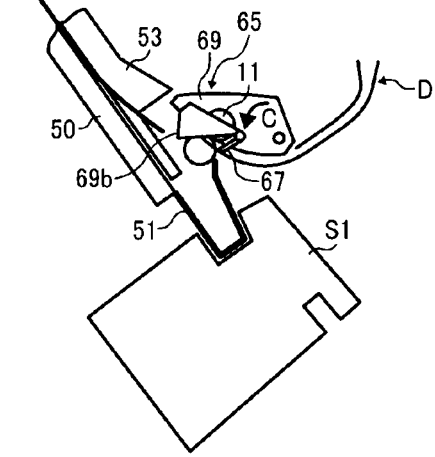

As shown in FIG. 6D, when the trailing edge of the sheet moves away from the staple sheet discharging rollers 11, the pressing surface 69*a* guides the sheet toward the sheet receiving portion 50 of the staple processing tray F by pressing the trailing edge of the sheet. Then, as shown in FIG. 6E, the sheet guide member 65 returns to the initial position by rotating further.

Figure 6F:
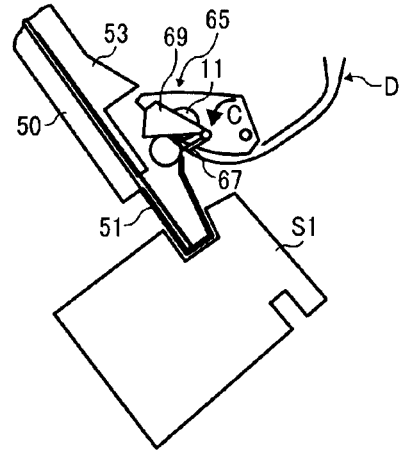

After that, as shown in FIG. 6F, the trailing edge of the sheet falls along the sheet receiving portion 50 and is stacked on the staple processing tray F by bumping to the rear fence 51. At this time, if the trailing edge of the sheet is curled to the staple sheet discharging rollers 11, the trailing edge of the sheet may fall toward the nip of the staple sheet discharging rollers 11. However, the sheet is prevented from flowing backwards and into the nip of the staple sheet discharging rollers 11 because the trailing edge of the sheet bumps into the guide surface 69*b* of the sheet guide member 65, which obstructs the nip portion of the staple sheet discharging rollers 11, and is instead guided to the rear fence 51 along the guide surface 69*b*.

As described above, in an exemplary embodiment, the pressing surface 69*a* of the sheet guide member 65 presses the sheet on the upstream side of the staple sheet discharging rollers 11 when the sheet guide member 65 is pushed up by the leading edge of the sheet and is returned to the initial position because the contact surface 67*a* of the sheet guide member 65 is located at the upstream side of the staple sheet discharging rollers 11 in the initial state. This makes it possible to prevent pressing the leading edge of the sheet discharged from the staple sheet discharging rollers 11 by the sheet guide member 65. As a result, it is possible to prevent a curl of the leading edge of the sheet due to the pressing by the sheet guide member 65 and a conveying malfunction caused by the curl.

Numerous additional modifications and variations are possible in light of the above teachings. It is therefore to be understood that within the scope of the appended claims, the disclosure of the present invention may be practiced otherwise than as specifically described herein.

For example, the cross-section shape of the sheet guide member 65 is configured in a V-shape by the rotation portion 67 and the pressing portion 69 in the above mentioned example. However the shape is not limited, especially as long as a contact surface of the sheet guide member 65 is located at upstream side of the staple sheet discharging rollers 11 when the sheet guide member is at the initial position, and the pressing surface of the sheet guide member 65 doesn't interfere with the sheet discharged from the staple sheet discharging rollers 11 when the sheet guide member 65 is at the evacuating position. For example, it is possible to change the shape into a square or pentagon, etc.

What is claimed is:

1. A sheet processing apparatus comprising:

a sheet conveying path configured to convey a sheet, a sheet stack tray that receives the sheet in order to stack the sheet, a sheet discharging member that discharges the sheet conveyed through the sheet conveying path to the sheet stack tray, the discharging member being a pair of discharging rollers, means for guiding the sheet that is movable from a first position that guides the sheet discharged from the sheet discharging member to a second position that opens a sheet path of the sheet discharging member, the means for guiding the sheet being arranged in the sheet processing apparatus such that the means for guiding the sheet extends from an upstream side of the sheet discharging member with respect to the sheet conveying path to a downstream side of the sheet discharging member, the means for guiding the sheet including a means for pressing a trailing edge of the sheet discharged from the sheet discharging member, and means for responding to the sheet that is arranged at the upstream side of the sheet discharging member with respect to the sheet conveying path, and that responds to the sheet conveyed through the sheet conveying path in order to move the means for guiding the sheet between the first and second positions, wherein the means for pressing urges a trailing edge of the sheet discharged from the sheet discharging member to the sheet stack tray by directly contacting a top surface of the sheet after the sheet is conveyed beyond the means for responding to the sheet such that the sheet no longer contacts the means for responding to the sheet, and the means for pressing and the means for responding to the sheet are arranged in the sheet processing apparatus such that, immediately after the sheet no longer contacts the means for responding to the sheet, the means for guiding the sheet rotates so that a base portion of the means for pressing directly contacts a top surface of the sheet before the trailing edge of the sheet is discharged from the sheet discharging member.

2. The sheet processing apparatus according to claim 1, wherein the means for pressing the trailing edge of the sheet is located above the sheet discharging path of the sheet discharging member when the means for guiding the sheet is in the second position.

3. The sheet processing apparatus according to claim 2, wherein the means for pressing the trailing edge of the sheet obstructs the sheet discharging path of the sheet discharging member when the means for guiding the sheet is in the first position.

4. The sheet processing apparatus according to claim 1, wherein the means for pressing the trailing edge of the sheet obstructs the sheet discharging path of the sheet discharging member when the means for guiding the sheet is in the first position.

5. The sheet processing apparatus according to claim 1, wherein the sheet conveying path is defined by a first guide plate and a second guide plate that are spaced apart from each other by a separation distance, and wherein the means for responding to the sheet extends from the means for guiding the sheet to an inside surface of the sheet conveying path such that a gap between a leading edge of the means for responding to the sheet and the inside surface of the sheet conveying path is smaller than the separation distance of the sheet conveying path when the means for guiding the sheet is in the first position.

6. An image forming apparatus comprising the sheet processing apparatus according to claim 1.

7. A method for guiding a sheet within a processing apparatus comprising:

conveying a sheet along a sheet conveying path, discharging the sheet conveyed through the sheet conveying path from a sheet discharge member into a sheet stack tray, the discharging member being a pair of discharging rollers, guiding the sheet into the sheet stack tray by moving a sheet guide member from a first position that guides the sheet discharged from the sheet discharging member to a second position that opens a sheet path of the sheet discharging member, the sheet guide member being arranged in the processing apparatus such that the sheet guide member extends from an upstream side of the sheet discharging member with respect to the sheet conveying path to a downstream side of the sheet discharging member, the moving the sheet guide member being initiated by a sheet contact portion located upstream of the sheet discharge member, wherein the guiding includes rotating the sheet guide member immediately after the sheet no longer contacts the sheet contact portion so that a sheet pressing portion of the sheet guide member located downstream of the sheet discharge member directly contacts a top surface of the sheet before a trailing edge of the sheet is discharged from the sheet discharging member.

* * * * *